United States Patent [19]

Gazzera

[11] Patent Number: 4,510,846

[45] Date of Patent: Apr. 16, 1985

[54] PNEUMATIC ACTUATOR DEVICE

[75] Inventor: Raymond W. Gazzera, Scottsdale, Ariz.

[73] Assignee: The United States of America as represented by the Secretary of the Air Force, Washington, D.C.

[21] Appl. No.: 418,947

[22] Filed: Sep. 16, 1982

[51] Int. Cl.[3] ..... F15B 17/02; F15B 13/16

[52] U.S. Cl. ..... 91/460; 91/358 R; 91/435; 137/85; 137/106; 137/627.5; 60/409

[58] Field of Search ..... 91/433, 435, 460, 465, 91/454, 455, 457, 464, 358 R, 418; 60/407, 409, 493, 390; 137/85, 106, 596.18, 627.5

[56] References Cited

U.S. PATENT DOCUMENTS

| | | | |
|---|---|---|---|
| 2,849,987 | 9/1958 | Shafer | 137/596.18 |
| 2,858,840 | 11/1958 | Wright, Jr. | 91/454 |
| 2,880,708 | 4/1959 | Hayner | 91/465 |
| 3,024,809 | 3/1962 | Shafer | 137/596.18 |
| 3,250,498 | 5/1966 | Cole | 244/78 |
| 3,268,186 | 8/1966 | Bosworth | 244/78 |
| 3,455,318 | 7/1969 | Jenney | 137/85 |
| 3,460,440 | 8/1969 | Brent | 91/464 |
| 4,052,024 | 10/1977 | Smith | 244/3.21 |
| 4,071,046 | 1/1978 | Cates | 137/627.5 |
| 4,075,930 | 2/1978 | Millett | 137/627.5 |
| 4,169,490 | 10/1979 | Taplin | 137/596.18 |

FOREIGN PATENT DOCUMENTS

| | | | |
|---|---|---|---|
| 804374 | 11/1958 | United Kingdom | 137/596.18 |

*Primary Examiner*—Charles T. Jordan
*Assistant Examiner*—Richard Klein
*Attorney, Agent, or Firm*—Donald J. Singer; Stanton E. Collier

[57] ABSTRACT

A closed center four-way poppet actuator control device is incorporated into a pneumatic actuation system for controlling the movement of flight surfaces. The closed center four-way poppet actuator control device has a housing, a pair of two-way poppet valves in the housing, a rocker arm assembly mounted on the housing and connected to the pair of two-way poppet valves, and a diaphragm assembly also mounted in the housing and in contact with the two-way valves. A torque motor-driver assembly connected to the diaphragm assembly actuates the two-way valves as determined by control signals. The rocker arm causes the two-way valves to function oppositely each other: one allows high pressure gas to be input to a lobe motor actuator while the other allows gas to be output from the lobe motor actuator. Each two-way valve has a cylindrical poppet valve for inletting the gas to the actuator and a disk poppet valve for outputting the gas from the actuator to a vent. The actuator causes movement of the flight surfaces through a gearbox. A velocity transducer monitors this movement and transmits this movement to an electronic control unit which sends control signals to drive the torque motor-driver assembly that actuates said actuator control device.

9 Claims, 3 Drawing Figures

PNEUMATIC ACTUATOR DEVICE

STATEMENT OF GOVERNMENT INTEREST

The invention described herein may be manufactured and used by or for the Government for governmental purposes without the payment of any royalty thereon.

BACKGROUND OF THE INVENTION

This invention relates generally to pneumatic actuation devices and, more particularly, to a servo actuator that controls the flow of high pressure gases to a pneumatic actuator that is used in missile flight control systems.

Servo systems operating with high pressure fluids have been widely used in missile flight control systems to move control fins. Hydraulic or electro-mechanical devices have been used in the past but these devices have not provided many of the desired characteristics. In particular, servo systems using high pressure gases have used piston actuators, spool valves or open center poppet valves in the actuator control valve assembly. This control valve assembly interfaces between a pressure regulator and a pneumatic actuator that controls the fins. The valve functions to control the direction of gas flow to and from the actuator. The piston actuator has limited power and poor response, and the valves are inefficient because of gas leakage and do not offer low leakage at null.

Another type of prior valve used is the closed center four-way poppet valve. This valve is made by attaching two poppets to one stem and another two poppets to another stem. The opening and closing of the poppets is controlled by a camlike mechanism so that two poppets operate as inlet ports and the other two operate as outlet ports. This type of valve has generally poor operating smoothness due to lack of pressure balance or friction. These drawbacks necessitated a search for an improved actuator control device.

SUMMARY

The instant invention sets forth an actuator control device having good pressure balance and linearity and thereby overcomes the problems noted hereinabove.

The actuator control device of the present invention uses four poppets. Two outlet poppets are mounted on control arms which cooperate through a self-centering rocker arm and are seated against inlet poppets which are movable but not attached to the control arms. Both inlet poppets are attached to bellows which form inlet pressure chambers between the bellows and the housing of the actuator valve. A torque motor-driver assembly creates a modulated pressure that is translated into a differential force by diaphragm assemblies which in turn act upon the control arms to move the outlet poppets accordingly. Two motor leg pressure chambers are also formed between the diaphragm assemblies, the housing, and the outlet poppets.

Depending upon the desired direction of the pneumatic actuator, a positive differential force is applied to a first control arm. This causes the inlet poppet to lift away from its seat but also causes the outlet poppet to remain seated against the inlet poppet. As a result, the high pressure gas entering the first inlet pressure chamber flows past the inlet poppet into the first motor leg pressure chamber and therefrom into the pneumatic actuator. The second control arm is then pushed in the opposite direction by the rocker arm so that the inlet poppet remains seated but the outlet poppet lifts off its seat. This action allows the exhaust gas from the actuator to enter the second motor leg pressure chamber and flow past the outlet poppet to be vented. By reversing the above process, the first motor leg pressure chamber exhausts and the second inlet pressure chamber allows gas to flow to the actuator.

It is therefore an object of this invention to provide for a closed center four-way poppet actuator control device that exhibits a four-way operation to run an air motor at variable speeds in opposite direction;

It is a further object of this invention to provide for a closed center four-way poppet actuator control device whose inlet and outlet valves are closed centered so as to preclude a short circuit between the inlet and outlet valves;

It is a still further object of this invention to provide for a closed center four-way poppet actuator control device whose inlet valves are shut at null so as to prevent leakage of fluid;

It is another object of this invention to provide for a closed center four-way poppet actuator control device whose exhaust valves are open at null;

It is still another object of this invention to provide for a closed center four-way poppet actuator control device having smooth operating characteristics over a desired range, minimizing deadband, minimizing fluid leakage, and minimizing actuating forces required.

These and many other objects and advantages of the present invention will be readily apparent to one skilled in the pertinent art from the following detailed description of a preferred embodiment of the invention and the claims when considered in conjunction with the drawings.

DETAILED DESCRIPTION OF THE PREFERRED EMBODIMENT

Figure 1:
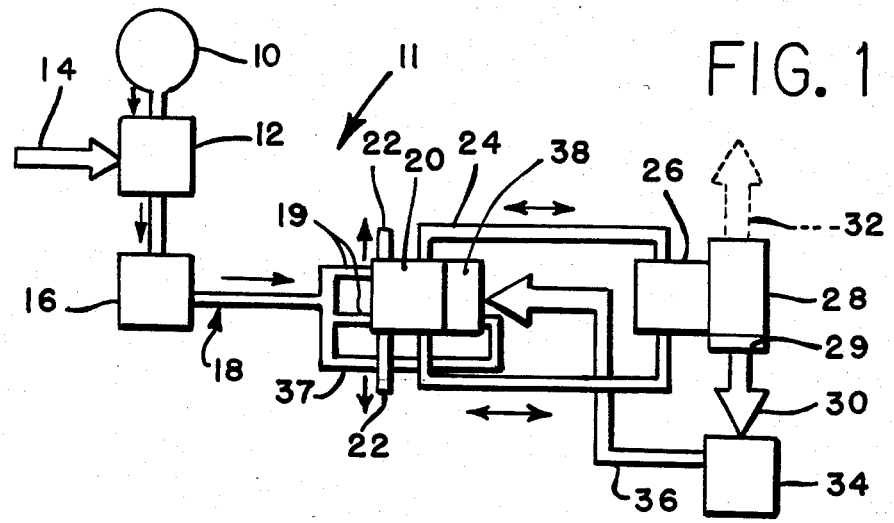
FIG. 1 is a schematic diagram of the pneumatic actuation system using the closed center four-way poppet actuator control device of the invention.

Referring to FIG. 1, a schematic of a pneumatic actuation system 11 is illustrated. For a clear understanding of an actuator control device 20 of this invention, reference is first made to a typical pneumatic actuation system 11 in which actuator control device 20 is incorporated. Although system 11 is commonly used with actuator control device 20, actuation control device 20 may be used with a variety of other systems. Pneumatic actuation system 11, for example, can be used to control aerodynamic surfaces on a spacecraft re-entering vehicle. The control of a re-entering vehicle requires a high powered servo mechanism with high frequency response. Such systems are extremely weight critical due to limitations of rocket boosters. By improving gas utilization and minimizing inertia of moving elements, a pneumatic actuation system is able to satisfy these requirements.

A container 10, FIG. 1, suitable for holding high pressure fluids, such as nitrogen or helium, provides the energy for driving pneumatic actuation system 11. System 11 is activated by initiation signals 14 that cause cutter valve 12 to release the high pressure gas in container 10 to a pressure regulator 16. Pressure regulator 16 consists of a sensing element, metering poppet, and a calibrated spring (all not shown). The sensing element reacting to the high pressure gas displaces against the calibrated spring causing the metering poppet to restrict the flow of gas between the inlet and outlet ports (not shown). By design, a constant maximum downstream regulated pressure is produced by pressure regulator 16 under normal operating conditions.

The regulated high pressure gas enters an inlet manifold 18. Manifold 18 has two passages 19 entering actuator control device 20 and a passage 37 entering a torque motor-driver assembly 38. Actuator control device 20 of this invention controls the flow of gas to and from actuator 26 and further selects the direction of rotation of actuator 26. Gas travels in passages 24 to and from actuator 26 and actuator control device 20. Exhaust gas is released through passages 22 of actuator control device 20. Actuator 26 can be a lobe motor having ability to rotate in either direction depending upon the application of gas pressure. Actuator 26 is connected to a conventional gearbox 28 which translates rotary motion of actuator 26 to linear motion 32 to a control surface assembly (not shown). A velocity transducer 29 is actuated by gearbox 28 and outputs electrical signals 30 which are directly proportional to linear motions produced by gearbox 28. Electrical signals 30 are input to an electronic control unit 34 and act as a velocity feedback for system 11. Electronic control unit 34 provides control signals 36 that control the speed and direction of rotation of the lobe motor. Control signals 36 are input into torque motor-drive assembly 38, shown in FIG. 3, which controls the pressure applied to actuator control device 20, and includes a flapper valve assembly 39 which causes changes in gas pressure in desired volume of actuator control device 20 to be detailed hereinafter.

Figure 2:
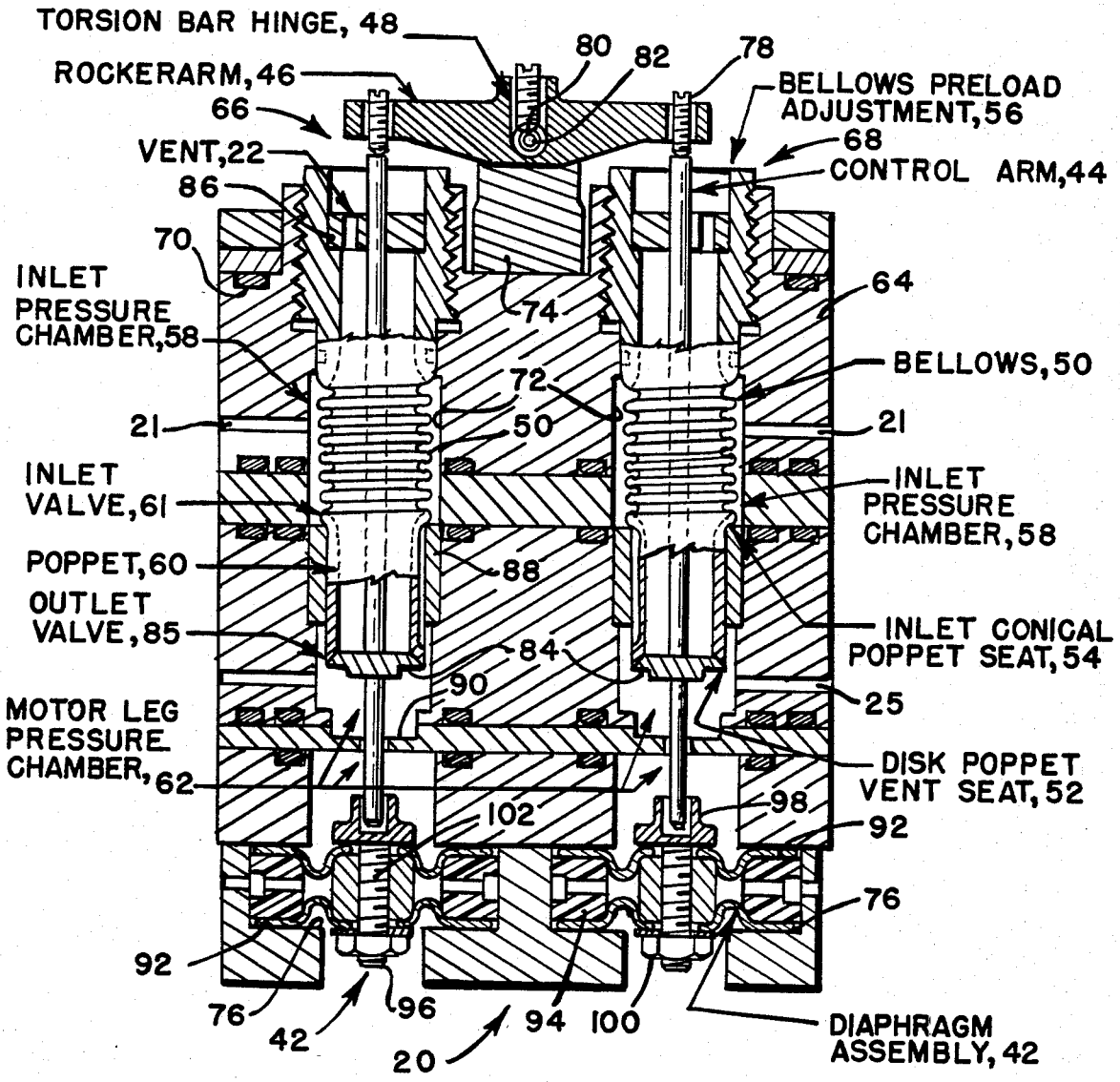
FIG. 2 is a schematic view in section of the closed center four-way poppet actuator control device of this invention.

Referring to FIG. 2, actuator control device 20 of the present invention is illustrated in section and Table I set forth below includes basic perfomance requirements applicable to meet desired characteristics of a particular flight control system. Actuator control device 20 has a housing 64, two two-way valves 66 and 68 and a rocker arm assembly 46. Because each of the two-way valves are identical in construction, the description of elements in two-way valve 66 are equally applicable to two-way valve 68. Therefore, for ease of understanding, the description of two-way valves 66 and 68 will only make reference to two-way valve 66 as required and the same reference numerals will be used in the Figures to identify identical elements in both valves.

TABLE I

| Parameter | Requirement |
|---|---|
| Valve Rate | Inlet area of $1.1 \times 10^{-5}$ square inch per psig of control pressure<br>Exhaust area of $3.3 \times 10^{-5}$ square inch per psig of control pressure |
| Valve range | Full open inlet area of 0.005 square inch at 400 R (R is constant of proportionality in gas equation)<br>Full open exhaust area of 0.015 square inch at 400 R |
| Leakage Area | To be relatively insignificant, leakage area must be approximately 0.0001 square inch per poppet |
| Valve Seating Forces | As required for minimum leakage and proportional to environment acceleration and valve mass |
| Mechanical Rate | Spring-mass system cannot resonate within environmental vibration (500 lb per in. minimum) |
| Deadband | Control pressure, ±3.5 psig maximum |
| Hysteresis | Control pressure, ±1.2 psig maximum |

Housing 64 of actuator control device 20 is made of metal such as aluminum and layered for ease of construction. A plurality of rubber o-rings such as o-ring 70 seal housing 64 when assembled by bolting, for example. Housing 64 further has two cylindrical-like voids vertically positioned in housing 64 and having openings in the top and bottom of housing 64 for holding two-way valves 66 and 68; two inlet ports 21 into which passages 19, FIG. 1, are connected; two inlet/outlet ports 25 into which passage 24, FIG. 1, is connected; a mounting base 74 on top of housing 64 onto which rocker arm assembly 46 is attached to housing 64; and two diaphragm mounting voids 76 located near the bottom of housing 64.

Two-way valve 66 is positioned in void 72 and operates cooperatively with two-way valve 68 by means of rocker arm assembly 46, shown in FIG. 2. A control arm 44 is in contact with adjusting screw 78 that is threaded into each arm of rocker arm 46. Rocker arm 46 has a torsion bar hinge 48 located therein which has a self-centering torsion bar spring 80 located at a pivot 82 so that rocker arm 46 has a tendency to return always to the null position. Refer to Table II set forth below for actual values applicable to spring 80.

Two-way valve 66 includes control arm 44 positioned longitudinally within void 72 and contacts adjusting screw 78 at the top and diaphragm assembly 42 at the bottom of housing 64. An outlet valve 85 has a disk poppet 84 which is fixedly mounted perpendicular to and on control arm 44 and has a poppet vent seat 52 machined onto the bottom of a cylindrical poppet 60. An inlet valve 61 has a cylindrical poppet 60 with an inlet conical poppet seat 54 which is held within void 72 by housing 64 and further longitudinally guides cylindrical poppet 60. Cylindrical poppet 60 has a cylindrical void therethrough so that control arm 44 passes therethrough. A bellows 50 is attached to the top of cylindrical poppet 60 and also has control arm 44 passing therethrough. A bellows preload adjustment device 56 is attached to the top of bellows 50 and is threaded into housing 64 so that the amount of force that presses cylindrical poppet 60 against conical poppet seat 54 can be easily adjusted externally from actuator control device 20. An upper control arm guide 86 is held in position by preload adjustment 56 so that control arm 44 remains centered within void 72 during operation. A lower control arm guide 90 is held in position by housing 64 and functions similar to guide 86. Vent 22 is formed in guide 86 to allow passage of gases to the atmosphere.

Actuator control device 20 has an inlet pressure chamber 58 for regulating high pressure gas fed through inlet port 21. Chamber 58 is formed by the surface of housing 64, preload adjustment device 56, bellows 50, cylindrical poppet 60 and conical poppet seat 54. Cylindrical poppet 60 has a pressure channel 88 formed on the external surface and runs longitudinally along cylindrical poppet 60 so that when cylindrical poppet 60 is lifted off seat 54, gas moves from inlet pressure chamber 58 to a motor leg pressure chamber 62. Motor leg pressure chamber 62 is formed by the surfaces of housing 64, cylindrical poppet 60, disk poppet 84, and diaphragm assembly 42. Inlet/outlet passage 25 allows movement of pressurized gas between motor leg pressure chamber 62 and lobe motor actuator 26.

A diaphragm assembly 42 is finally mounted in diaphragm mounting void 76 which is a cylindrically shaped ring-like void formed in housing 64. Diaphragms 92 are made of a plastic material, preferably silastic. A plurality of diaphragm spacers, such as spacer 94, insure a proper pressure seal when housing 64 and adjusting means 96, such as a nut 100, bolt 102 and a cup 98, are assembled. Control arm 44 is held by cup 98 so that movement of diaphragm assembly 42 is transmitted to control arm 44. The assembled closed center four four-way poppet actuator control device 20 is designed to meet the performance requirements as shown in Table II.

TABLE II

| Parameter | Value |
|---|---|
| Bellows Assembly | |
| Rate | 250 pounds per inch |
| Effective Area | 0.083 square inch |
| Inside Diameter (vent area) | 0.260 inch (minimum) |
| Operating Pressure (external) | 650 psig |
| Preload | 0.3 pound |
| Stroke (in compression) | 0.030 inch |
| Ambient Temperature | Minus 65 F. to +160 F. |
| Preload Length (overall) | 0.380 inch |
| Proof Pressure | 925 psig |
| Inlet Poppet Valve | |
| Inlet Seat Diameter | 0.332 inch gauge |
| Seat Cone Angle | 25 degrees |
| Torsion Bar Spring | |
| Rate | 500 pound per inch |
| Adjustment Required | Zero |
| Diaphragms | |
| Effective Area | 0.086 square inch |
| Stroke | ±0.30 inch |
| Rate | Below 50 lb per inch |
| Vent Seat | |
| Conical Angle at Seat | 45 degrees |
| Diameter | 0.314 inch |

Figure 3:
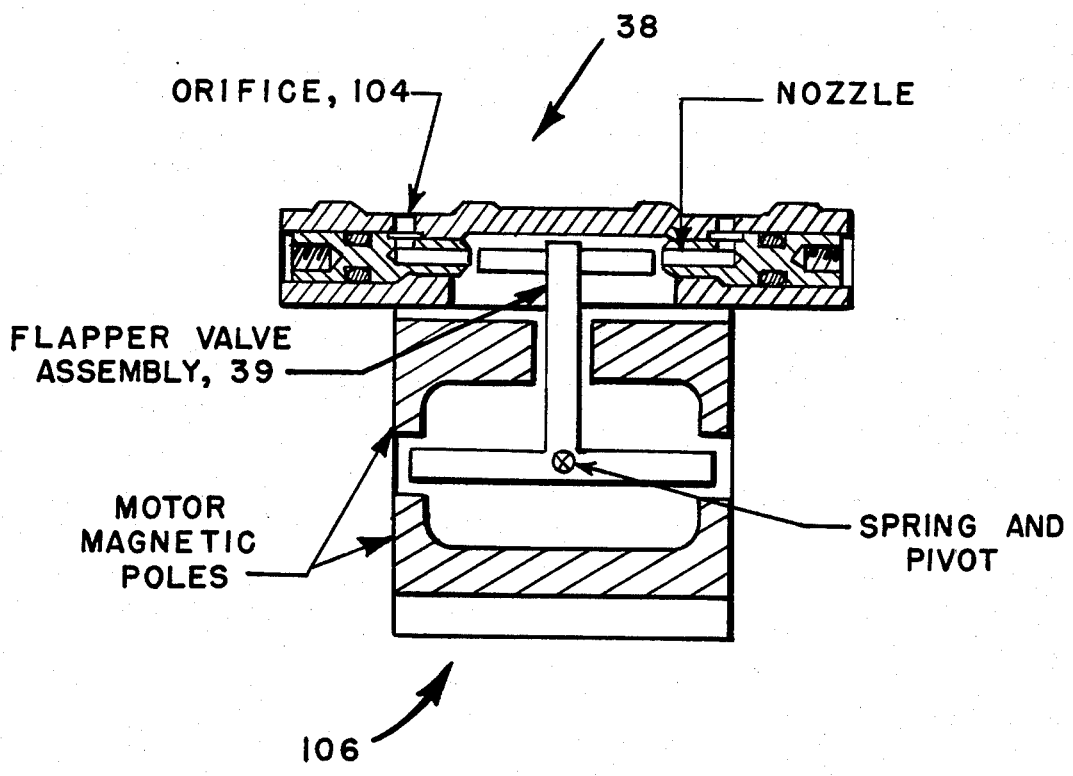
FIG. 3 is a schematic view in section of the torque motor-driver that actuates the actuator control device of this invention.

The actuating device for closed center four-way poppet actuator control device 20 is torque motor-driver assembly 38 which is attached to the bottom of actuator control device 20. The driver of assembly 38 can be a flapper valve assembly 39 as shown in FIG. 3. Referring to FIG. 3, an orifice 104 fed by passage 37, FIG. 1, allows the modulated high pressure gas to act upon diaphragm assembly 42. Modulation of lobe motor actuator 26 is controlled by closed center four-way poppet actuator control device 20 in cooperation with torque motor-driver assembly 38. A modulated pressure created by control signals 36 cause excitation of a torque motor 106 which is converted to a differential force by diaphragm assembly 42, control arm 44, and rocker arm 46 arrangement. The output force of torque motor-driver assembly 38 is used to position cylindrical poppet 60 and disk poppet 84 that are closed center. Movement of cylindrical poppet 60 is fed back to torque motor-driver assembly 38 through rocker arm assembling 46. The spring rates of bellows 50 and control arm 44 and diaphragm assembly 42, loaded by adjusting screws 78, assure that there is zero backlash in the mechanism. This position feedback enhances overall system response characteristics and increases both positional accuracy and resolution.

The poppet valves are balanced with respect to inlet pressure and are nearly balanced for motor pressure entering inlet/outlet port 25. The pressure feedback resulting from the motor pressure unbalance between inlet/outlet pressure is extremely effective in stabilizing the poppet valves 61 and 85.

Table III shows performance characteristics of closed center four-way poppet actuator control device 20.

TABLE III

FOUR-WAY VALVE TEST RESULTS

| Parameter | Value |
|---|---|
| Gain | 0.0013 inch per milliamp |
| Hysteresis | ±1.25 milliamp |
| Deadband | ±6.5 milliamp |
| Area Ratio ($A_{EXHAUST}/A_{INLET}$) | 4.5 (nominal) |
| Inlet Poppet Leakage Area | 0.0002 square inch |
| Response (at 45-degree phase lag including torque motor and driver) | 25 Hz |

The type of gas used in pneumatic actuator system 11 influences valve area size. By continuity and neglecting motor leakage $$\text{Motor Flow} = \text{Valve Flow}$$

$$\frac{P_2 N V_D}{60RT} = \frac{K P_3 A_E N_{34}}{\sqrt{T}}$$

where $P_1$ is ambient pressure,
$P_2$ is motor inlet pressure,
N is motor speed,
$V_D$ is motor displacement,
T is fluid temperature,
$A_E$ is exhaust valve area,
R is ideal gas constant,
K is gas constant, and
$N_{34}$ is Smith coefficient for flows from $P_3$ to $P_4$.

For a given operating condition, $P_2$, $P_3$, N, $V_D$, and T are constants which are independent of gas properties.

For helium and nitrogen, the $N_{34}$ factors are nearly equal and $K_{He}=0.208$,
$K_N=0.532$,
$R_{He}=4636$,
$R_N=640$,
$K_{He} R_{He} A_{EHe}=K_N R_N A_{EN}$, and $$A_{EHe}/A_{EN} = \frac{(0.532)\ (640)}{(0.208)\ (4636)} = \frac{1}{2.83}$$

Thus, valve size requirements for a system operating with nitrogen gas are 2.8 times the area required for operating with helium.

Closed center four-way poppet actuator control device 20 has basically two inlet valves 61 and two outlet valves 85 connected by control arms 44 and rocker arm assembly 46. When fully assembled, torque motor-driver assembly 38 having two diaphragms 42 controls the differential pressure across a lobe motor actuator 26.

The valving is arranged in housing 64 so that two-way valve 66 having one inlet valve 61 and one outlet valve 85 controls one pressure leg to lobe motor actuator 26. The other leg is controlled by other two-way valve 68. Movement of either control arms 44, caused by diaphragm assembly 42, toward rocker arm 46 causes one inlet valve 61 to open by the lifting of cylindrical poppet 60 from conical poppet seat 54 and allows high pressure gas in inlet pressure chamber 58 to flow into one side of lobe motor actuator 26. Simultaneously, rocker arm 46 acts to open outlet valve 85 in the other two-way valve by lifting disk poppet 84 off vent seat 52 to vent the other side of lobe motor actuator 26. Both inlet valves 61 are closed at null to prevent leakage, both outlet valves 85 are open at null, and valves 61 and 85 are closed centered so as to prevent gas flow from inlet pressure chamber 58 to vent 22 through outlet valve 85.

Clearly, many modifications and variations of the present invention are possible in light of the above teachings and is therefore understood that, within the scope of the inventive concept, the invention may be practiced otherwise than specifically described.

I claim:

1. An actuator control device in combination with a pneumatic actuation system having an actuator comprising:

a housing composed of a material able to withstand high pressure and having two first voids positioned longitudinally therein with openings on the top and the bottom of said housing, said housing having one inlet port for each of said first voids communicating between the exterior of said housing and said first voids, and having one inlet/outlet port for each of said first voids communicating between the exterior of said housing and said first voids;

means for controlling the flow of high pressure gas to and from said actuator, said controlling means includes two means for valving, each of said valving means mounted in each of said first voids; each of said valving means includes an inlet valve and an outlet valve and a control arm connected to said outlet valve, said valving means provides a two-way valve capability, said control arm being adjustably secured to said interconnecting means at the top of said housing and being fixedly connected to amplifying means near the bottom of said housing; said outlet valve having a disk poppet fixedly attached to said control arm and a disk poppet set positioned on said inlet valve; said inlet valve having a cylindrical poppet with said disk poppet seat on the bottom and a conically shaped top, an inlet conical poppet set into which said conically shaped top movably contacts, a bellows having a bottom fixedly attached to the top of said cylindrical poppet, a bellow preload adjustment device having the top of said bellows attached to the bottom thereon and said adjustment device movably attached to said housing so that the amount of force applied through said adjustment device having a vent therein and having said control arm axially located therein, and a lower control arm guide attached to said housing having said control arm axially located therein;

means for movably interconnecting said valving means directly connected to said control arm of each of said outlet valves; and said outlet valves operably connected to said inlet valves, respectively, so that when one valving means is inputting high pressure gas to said actuator, the other of said valving means is venting gas from said actuator; and said amplifying means operably connected to said control arms of said valving means for amplifying actuating forces applied to said actuator control device by a torque motor-driver assembly.

2. An actuator control device as defined in claim 1 wherein each of said two-way valves has an inlet pressure chamber connected to said inlet port, and a motor leg pressure chamber connected to said inlet/outlet port, said inlet pressure chamber is formed by surfaces of said housing, said bellows preload adjustment device, said bellows, said cylindrical poppet, and said conical poppet seat, said motor leg pressure chamber is formed by surfaces of said housing, said conical poppet seat, said cylindrical poppet, said disk poppet, and a diaphragm assembly whereby the lifting of said cylindrical poppet of one of said two-way valves causes high pressure gas to flow from said inlet pressure chamber by said cylindrical poppet to said motor leg pressure chamber to said actuator and the lifting of said disk poppet by said movably connecting means in the other two-way valve causes exhaust gas from said actuator to enter said motor leg pressure chamber through said inlet/outlet port, pass by said disk poppet and through said vent.

3. An actuator control device as defined in claim 2 wherein said movably interconnecting means comprises a rocker arm assembly fixedly mounted to a mounting base located between said first voids on said housing, said rocker arm having two arms, each arm having an adjusting screw therein which is in moving contact with each of said control arms of each of said two-way valves, said rocker arm having a torsion bar spring means that centers said rocker arm on a pivot.

4. An actuator control device as defined in claim 3 wherein said amplifying means includes a pair of diaphragm assemblies, each diaphragm is mounted in a holding means fixed to said housing, for providing vibrating movement longitudinal to said housing, a cup is mounted on the top side of said diaphragm and said control arm is mounted therein whereby pulsating pressure applied to the bottom side of said diaphragm is amplified to cause translating movement of said control arms.

5. An actuator control device as defined in claim 4 wherein said diaphragm is made of silastic plastic material.

6. An actuator control device as defined in claim 5 wherein said actuator is a bi-directional lobe motor.

7. An actuator control device as defined in claim 6 wherein said high pressure gas has a pressure of about 600 pounds per square inch.

8. An actuator control device as defined in claim 7 wherein said inlet valve has an inlet seat diameter of about 0.332 inches gauge and a seat angle of about 25 degrees, and said outlet valve has seat diameter of about 0.314 inches gauge and a seat angle of about 45 degrees.

9. An actuator control device as defined in claim 8 wherein said torsion bar spring has a spring rate of about 500 pounds per inch.

* * * * *